US011633840B2

(12) United States Patent
Liu et al.

(10) Patent No.: US 11,633,840 B2
(45) Date of Patent: Apr. 25, 2023

(54) ELECTRIC NAIL GUN

(71) Applicant: BASSO INDUSTRY CORP., Taichung (TW)

(72) Inventors: An-Gi Liu, Taichung (TW); Yuan-Chi Chiang, Taichung (TW)

(73) Assignee: Basso Industry Corp., Taichung (TW)

( * ) Notice: Subject to any disclaimer, the term of this patent is extended or adjusted under 35 U.S.C. 154(b) by 41 days.

(21) Appl. No.: 17/202,446

(22) Filed: Mar. 16, 2021

(65) Prior Publication Data

US 2021/0291335 A1 Sep. 23, 2021

(30) Foreign Application Priority Data

Mar. 17, 2020 (TW) ..... 109108794

(51) Int. Cl.
*B25C 1/00* (2006.01)
*B25C 1/04* (2006.01)
*B25C 1/06* (2006.01)

(52) U.S. Cl.
CPC ..... *B25C 1/008* (2013.01); *B25C 1/047* (2013.01); *B25C 1/06* (2013.01)

(58) Field of Classification Search
CPC ..... B25C 1/008; B25C 1/047; B25C 1/06
See application file for complete search history.

(56) References Cited

U.S. PATENT DOCUMENTS 10,173,310 B2 * 1/2019 Wyler ..... B25C 1/06
2007/0095876 A1 * 5/2007 Oda ..... B25C 1/06 227/131
2008/0067213 A1 * 3/2008 Shima ..... B25C 1/06 227/129
2009/0032566 A1 * 2/2009 Liang ..... B25C 1/06 227/131
2009/0090762 A1 * 4/2009 Leimbach ..... B25C 5/13 227/136
2009/0095787 A1 * 4/2009 Liang ..... B25C 1/06 227/131
2009/0236387 A1 * 9/2009 Simonelli ..... B25F 5/006 227/8
2011/0198381 A1 * 8/2011 McCardle ..... B25C 1/04 227/8
2013/0248216 A1 * 9/2013 Tsuchiya ..... B25F 5/02 173/18
2016/0229043 A1 * 8/2016 Wyler ..... B25C 1/047
2016/0288305 A1 * 10/2016 McCardle ..... B25C 1/047
2017/0001291 A1 * 1/2017 Schnell ..... B25C 1/044
(Continued)

*Primary Examiner* — Joshua G Kotis
*Assistant Examiner* — Katie L Gerth
(74) *Attorney, Agent, or Firm* — Burris Law, PLLC

(57) ABSTRACT

An electric nail gun includes a nail-striking subunit that is adapted to strike a nail, a lifting wheel that is movable to become engageable and not engageable with the nail-striking subunit, a driving member that is rotatable by a motor, and a transmission shaft that is movably connected between the driving member and the lifting wheel, and that is convertible between a first position, where the lifting wheel is engageable with the nail-striking subunit such that rotation of the driving member results in movement of the nail-striking subunit, and a second position, where the lifting wheel is not engageable with the nail-striking subunit such that rotation of the driving member does not result in movement of the nail-striking subunit.

7 Claims, 9 Drawing Sheets

(56) References Cited

U.S. PATENT DOCUMENTS

| | | | | |
|---|---|---|---|---|
| 2017/0190037 | A1* | 7/2017 | Sato | B25C 1/06 |
| 2018/0126528 | A1* | 5/2018 | Pomeroy | B25C 1/06 |
| 2019/0126453 | A1* | 5/2019 | Po | B25C 1/047 |
| 2019/0202042 | A1* | 7/2019 | Wu | B25C 1/04 |

* cited by examiner

ELECTRIC NAIL GUN

CROSS-REFERENCE TO RELATED APPLICATION

This application claims priority of Taiwanese Patent Application No. 109108794, filed on Mar. 17, 2020.

FIELD

The disclosure relates to a nail gun, and more particularly to an electric nail gun.

BACKGROUND

Referring to FIGS. 1 and 2, a conventional electric nail gun 1 disclosed in U.S. patent Ser. No. 10/173,310 includes a motor casing 10, a striking member 11, a lifting wheel 12, an output shaft 13, a motor 14, a speed reduction unit 15, a ring seat 16 and a plurality of engaging members 17.

The striking member 11 is movable along a first axis (X1) for striking a nail (not shown). The motor casing 10 is disposed proximate to the striking member 11, and surrounds a second axis (X2) skewed to the first axis (X1). The output shaft 13 is mounted in the motor casing 10, is rotatable about the second axis (X2) relative to the motor casing 10, and has an end extending out of the motor casing 10 toward the striking member 11. The lifting wheel 12 is co-rotatably connected to said end of the output shaft 13, and is engageable with the striking member 11 such that rotation of the output shaft 13 drives movement of the striking member 11 along the first axis (X1).

The motor 14 is fixedly mounted in the motor casing 10. The speed reduction unit 15 is connected between the motor 14 and the output shaft 13 such that the motor 14 drives the rotation of the output shaft 13. The ring seat 16 is fixed to the motor casing 10, surrounds the output shaft 13 and is adjacent to the speed reduction unit 15.

Specifically, the speed reduction unit 15 is a planetary gear set which includes a plurality of planet gears 151 and a ring gear 153. The planet gears 151 are connected to the output shaft 13 and, as the output shaft 13 rotates, orbit about the second axis (X2). The ring gears 153 surrounds and is movably engaged with the planet gears 151, and is formed with a plurality of stopping protrusions 152 that are arranged about the second axis (X2) and that protrude toward the ring seat 16. Each of the engaging members 17 movably extends through the ring seat 16 and is biased by a compression spring toward the ring gear 153.

During a normal operation, each of the engaging members 17 abuts resiliently against a side surface of a respective one of the stopping protrusions 152 of the ring gear 153 such that the engaging members 17 prohibit the ring gear 153 from rotating about the second axis (X2) relative to the motor 14. As such, and the motor 14 drives the planet gears 151 to move (i.e., orbit and rotate) to further drive the rotation of the output shaft 13.

If a malfunction occurs during the operation that causes the striking member 11 to become stuck and in turn stop the rotation of the output shaft 13, the planet gears 151 are thus prohibited from orbiting about the second axis (X2) and are only allowed to rotate on their own axes. As a result, a torque is exerted on the ring gear 153 that causes the stopping protrusions 152 thereof to overcome the biasing force of the compression springs and slide past the respective engaging members 17, thereby allowing the ring gear 153 to rotate relative to the motor 14. As such, the motor 14 is in a state of idle running and is prevented from being damaged due to the malfunction.

However, assembly of the ring seat 16, the engaging members 17 and the speed reduction unit 15 can be an intricate process and the idling of the motor 14 can easily wear out components involved therein (e.g., the engaging members 17 and the stopping protrusions 152 of the ring gear 153).

SUMMARY

Therefore, the object of the disclosure is to provide an electric nail gun that can alleviate at least one of the drawbacks of the prior art.

According to the disclosure, an electric nail gun includes a muzzle unit, a cylinder unit, a lifting wheel, a casing, a motor unit, a driving member and a transmission shaft. The muzzle unit surrounds a striking axis and includes a nail gun seat adapted for loading a nail. The cylinder unit includes a striking cylinder that is connected to the muzzle unit along the striking axis, and a nail-striking subunit that is disposed in the muzzle unit and the striking cylinder, that extends along the striking axis, and that is adapted to be driven by air pressure in the striking cylinder to move along the striking axis for striking the nail. The lifting wheel is mounted to the muzzle unit, and is rotatable about and movable along a rotational axis. The lifting wheel is movable along the rotational axis between a default position, where the lifting wheel is engageable with the nail-striking subunit such that rotation of the lifting wheel results in movement of the nail-striking subunit along the striking axis so as to increase the air pressure in the striking cylinder, and a shifted position, where the lifting wheel is not engageable with the nail-striking subunit. The casing is connected to the muzzle unit, and surrounds the rotational axis. The motor unit is mounted to the casing. The driving member is mounted in the casing, is connected to and drivable by the motor unit to rotate about the rotational axis, and has a plurality of spaced-apart first coupling portions that are arranged about the rotational axis. The transmission shaft is disposed between the driving member and the lifting wheel, has a plurality of spaced-apart second coupling portions that are arranged about the rotational axis and that are respectively movably engaged with the first coupling portions, and is co-rotatably and co-movably connected to the lifting wheel such that the transmission shaft is convertible relative to the driving member along the rotational axis between a first position, where the lifting wheel is at the default position such that rotation of the driving member results in movement of the nail-striking subunit along the striking axis, and a second position, where the lifting wheel is at the shifted position such that rotation of the driving member does not result in movement of the nail-striking subunit along the striking axis.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
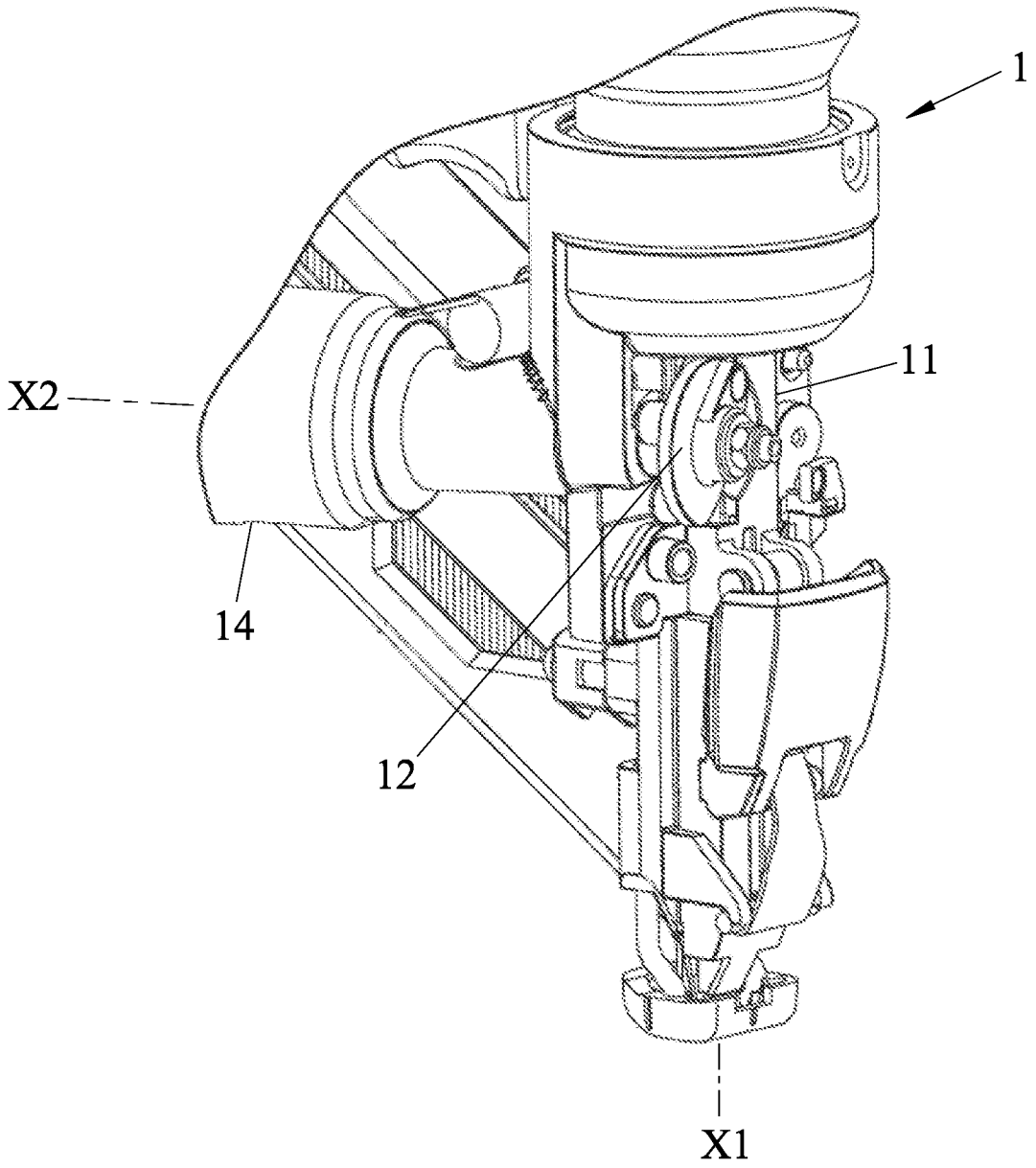
FIG.1 PRIOR ART
FIG. 1 is a fragmentary perspective view of a conventional electric nail gun disclosed in U.S. patent Ser. No. 10/173,310.
Figure 2:
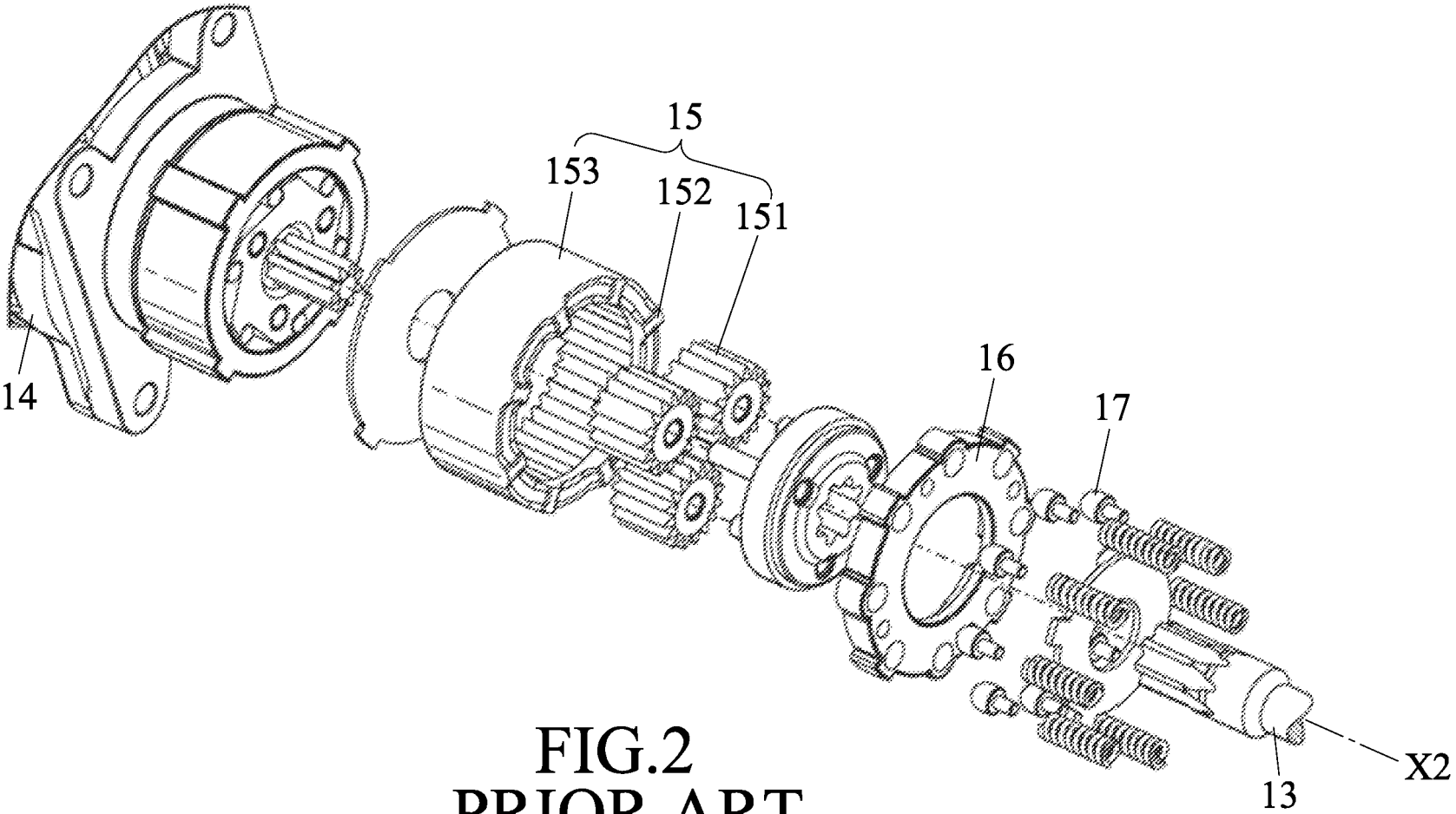
FIG.2 PRIOR ART
FIG. 2 is a fragmentary exploded perspective view of the conventional electric nail gun.
Figure 3:
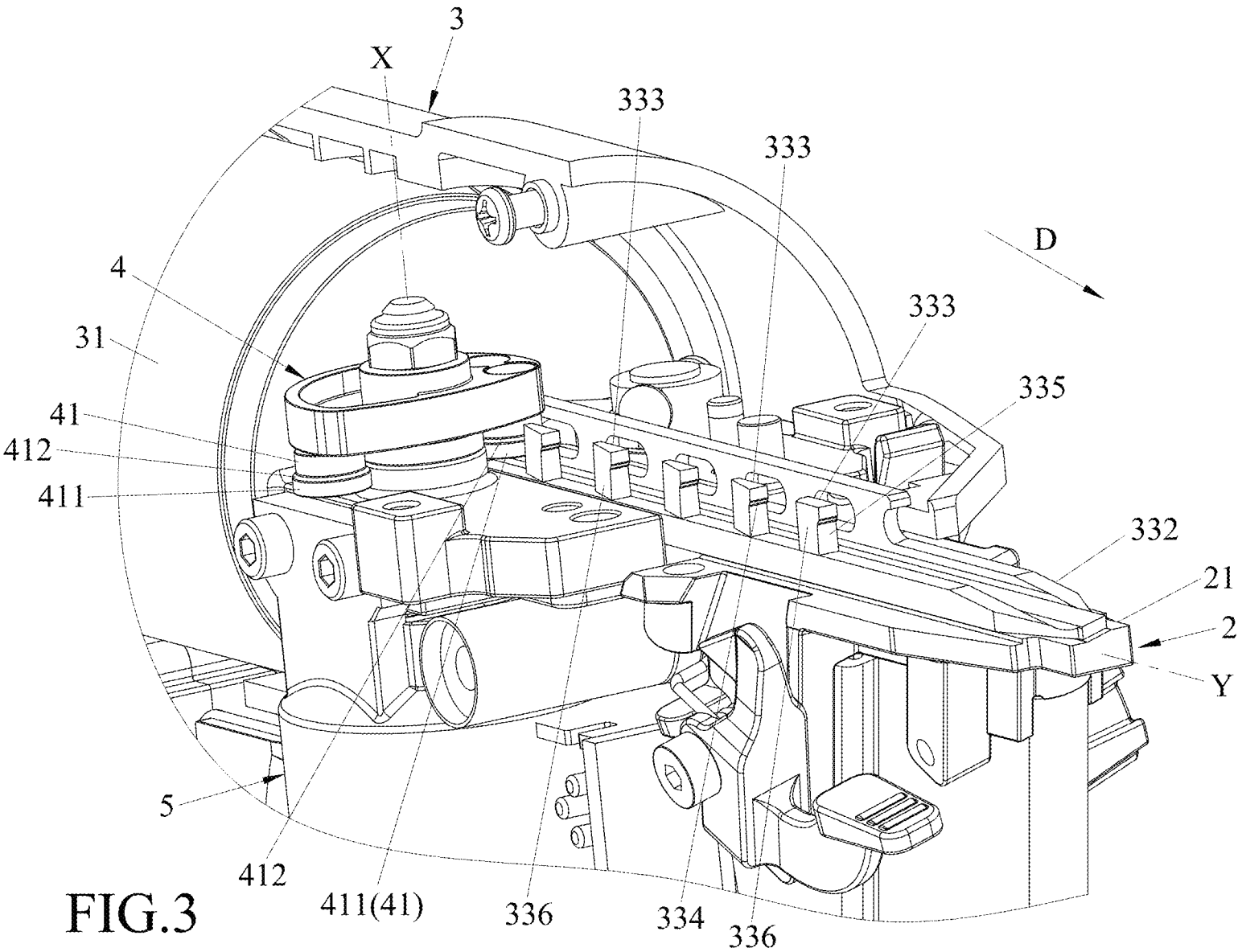
FIG. 3 is a fragmentary perspective view illustrating an embodiment of an electric nail gun according to the disclosure.
Figure 4:
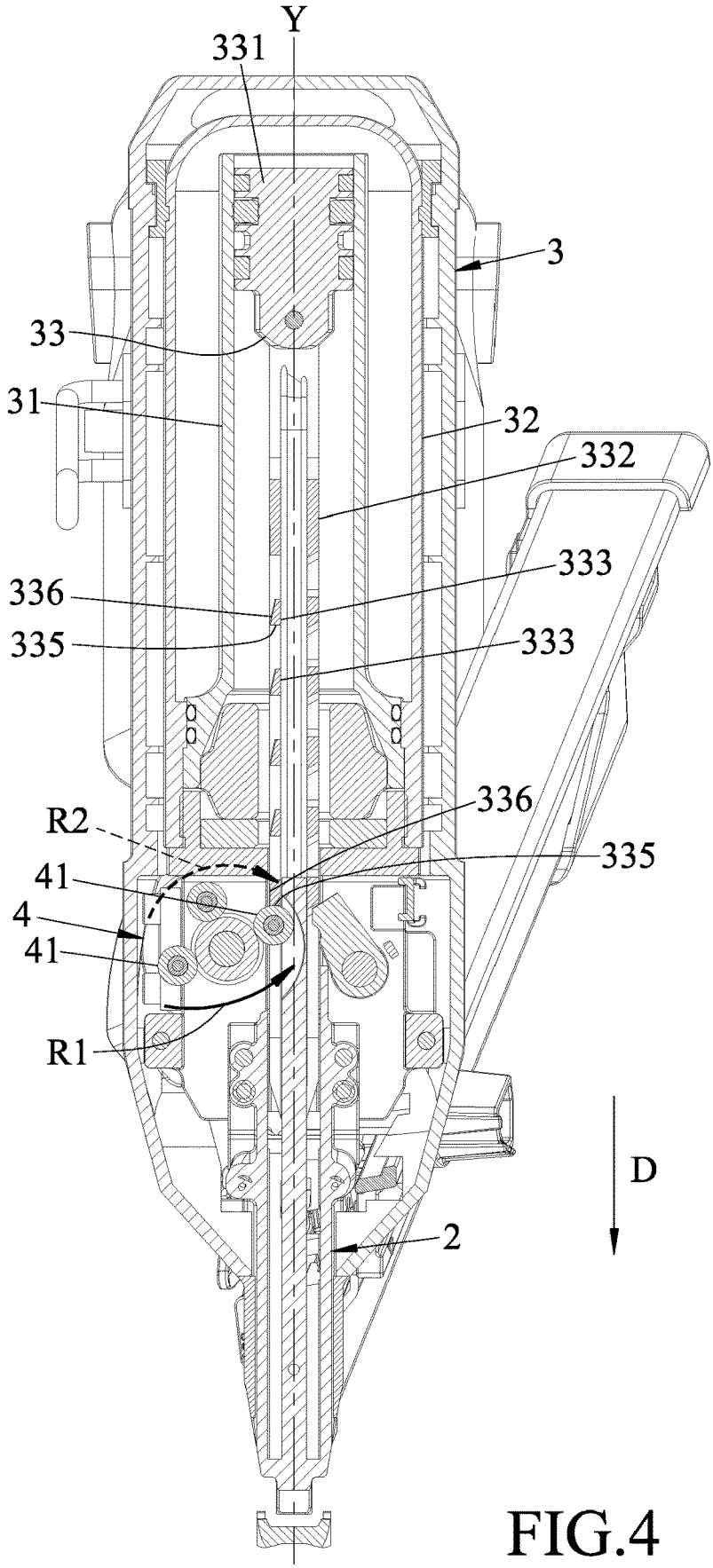
FIG. 4 is a sectional view of the embodiment.
Figure 5:
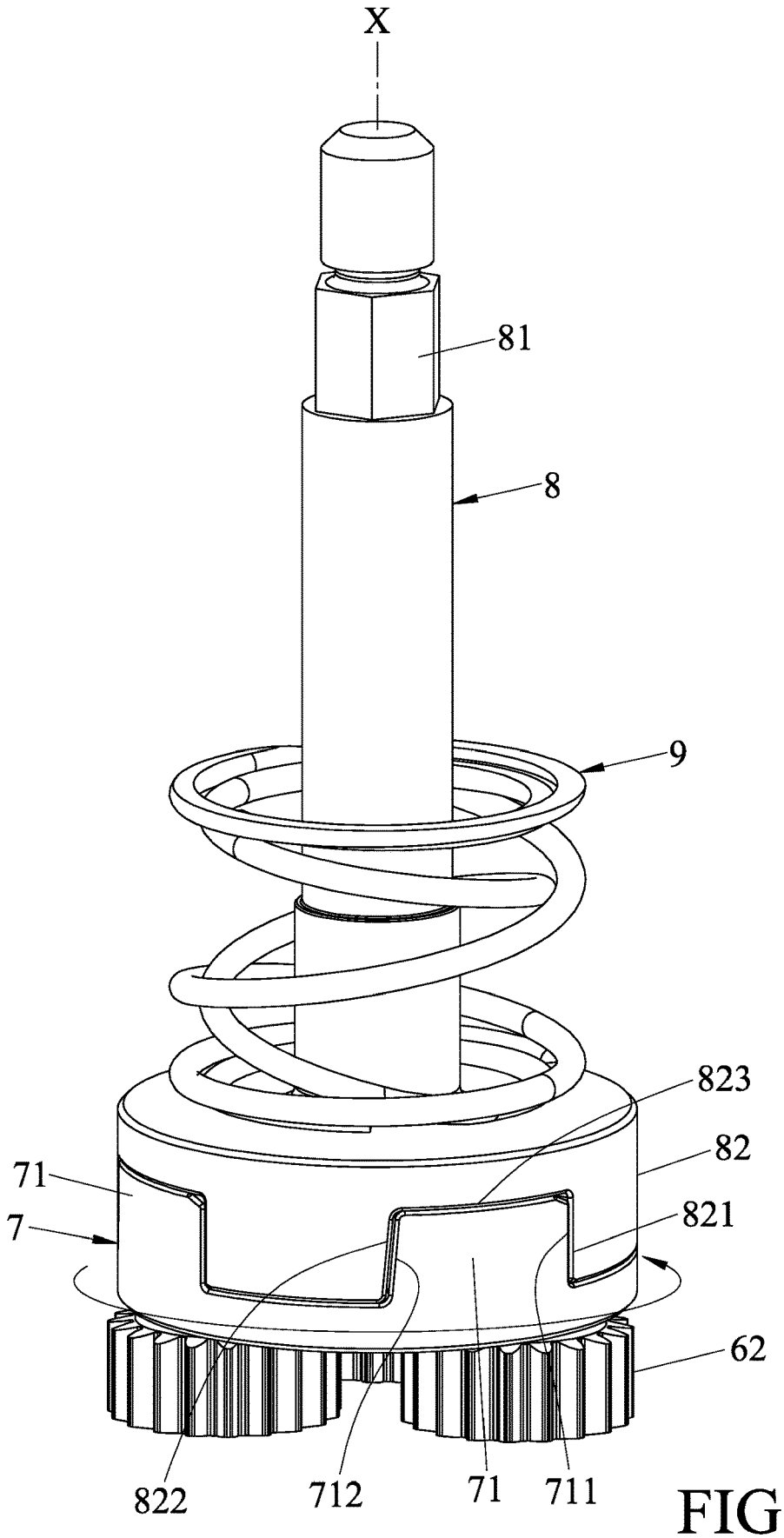
FIG. 5 is a perspective view illustrating parts of a reduction gear set, a driving member, a transmission shaft and a resilient member of the embodiment, and illustrating that the transmission shaft is at a first position.

Referring to FIGS. 3, 4 and 5, an electric nail gun according to the disclosure includes a muzzle unit 2, a cylinder unit 3, a lifting wheel 4, a casing 5, a motor unit 6, a driving member 7, a transmission shaft 8 and a resilient member 9.

The muzzle unit 2 surrounds a striking axis (Y) that extends in a striking direction (D), and includes a nail gun seat 21 that is adapted for loading a nail (not shown).

The cylinder unit 3 includes a striking cylinder 31, a storage cylinder 32 and a nail-striking subunit 33. The striking cylinder 31 is connected to the muzzle unit 2 along the striking axis (Y). The storage cylinder 32 surrounds and is spatially communicated with the striking cylinder 31, and is adapted for storing air under a predetermined air pressure.

The nail-striking subunit 33 is disposed in the muzzle unit 2 and the striking cylinder 31, extends along the striking axis (Y), and is adapted to be driven by air pressure in the striking cylinder 31 to move along the striking axis (Y) for striking the nail in the striking direction (D).

Specifically, the nail-striking subunit 33 includes a piston 331, a firing pin 332 and a plurality of spaced-apart first engaging members 333. The piston 331 is disposed in the striking cylinder 31 and is movable along the striking axis (Y). The firing pin 332 is connected to the piston 331, is movable on the nail gun seat 21 along the striking axis (Y), and is adapted for striking the nail. The first engaging members 33 are fixed on the firing pin 332 and are arranged in the striking direction (D).

It should be noted that the first engaging members 333 are not limited to be fixed on the firing pin 332. In variations of the present embodiment, the electric nail gun may further include a lifting rod that is parallel to the firing pin 332, and the first engaging members 333 may be fixed thereon.

The lifting wheel 4 is mounted to the muzzle unit 2, is rotatable about and movable along a rotational axis (X), and is movable along the rotational axis (X) between a default position and a shifted position relative to the nail-striking subunit 33.

When at the default position, the lifting wheel 4 is engageable with the nail-striking subunit 33 such that rotation of the lifting wheel 4 results in movement of the nail-striking subunit 33 along the striking axis (Y) so as to increase the air pressure in the striking cylinder 31. When at the shifted position, the lifting wheel 4 is not engageable with the nail-striking subunit 33.

Specifically, the lifting wheel 4 includes a plurality of spaced-apart second engaging members 41 that are arranged about the rotational axis (X), and that are provided for engagement with the first engaging members 333 of the nail-striking subunit 33. With regard to the aforementioned engagement, structural details of the first and second engaging members 333, 41 are described as follows.

Each of the first engaging members 333 of the nail-striking subunit 33 has a restricting shoulder surface 334, a lifting surface 335 and a sliding surface 336. For each of the first engaging members 333, the restricting shoulder surface 334 faces the firing pin 332 of the nail-striking subunit 33, the lifting surface 335 is connected to the restricting shoulder surface 334 and faces the striking direction (D), and the sliding surface 336 is connected to the lifting surface 335, is slanted with respect to a direction of the rotational axis (X), and extends from the firing pin 332 in a direction away from the nail gun seat 21 and the rotational axis (X).

Each of the second engaging members 41 of the lifting wheel 4 is provided to contact one of the lifting surface 335 and the sliding surface 336 of one of the first engaging members 333, and has a contact surface 411 and a stopping shoulder surface 412 that is connected to the contact surface 411.

When the lifting wheel 4 is at the default position and is engaged with the nail-striking subunit 33, the contact surface 411 of at least one of the second engaging members 41 abuts against the lifting surface 335 of at least one of the first engaging members 333, and the restricting shoulder surface 334 of the at least one of the first engaging members 333 faces the stopping shoulder surface 412 of the at least one of the second engaging members 41, thereby preventing the lifting wheel 4 from moving from the default position to the shifted position.

When the lifting wheel 4 is at the default position and is not engaged with the nail-striking subunit 33, if the contact surface 411 of one of the second engaging members 41 is brought into contact with the sliding surface 336 of one of the first engaging members 333, the one of the second engaging members 41 is urged by the sliding surface 336 to slide thereacross, thereby driving the lifting wheel 4 to move from the default position to the shifted position (see FIG. 3).

Figure 6:
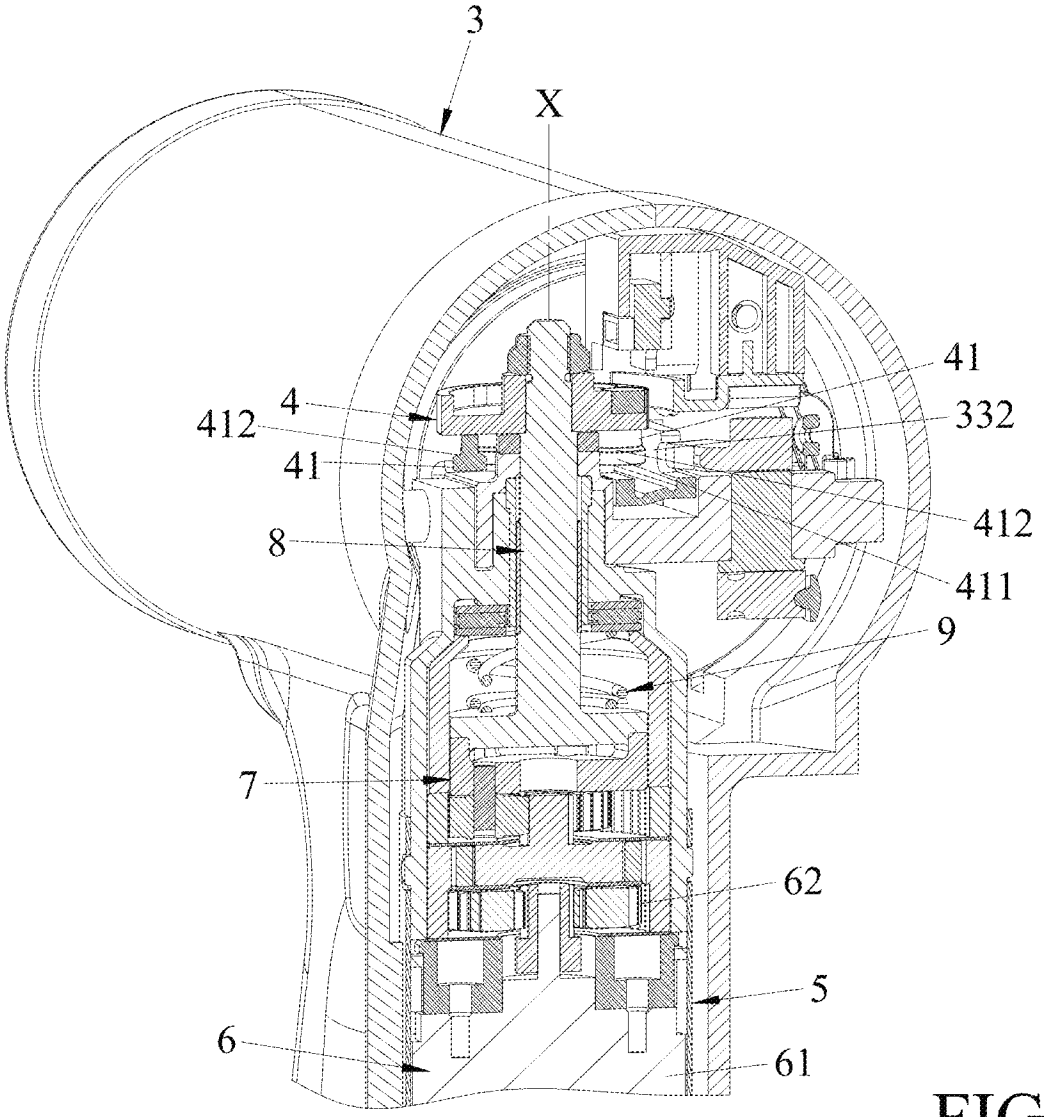
FIG. 6 is a fragmentary sectional view of the embodiment.
Figure 7:
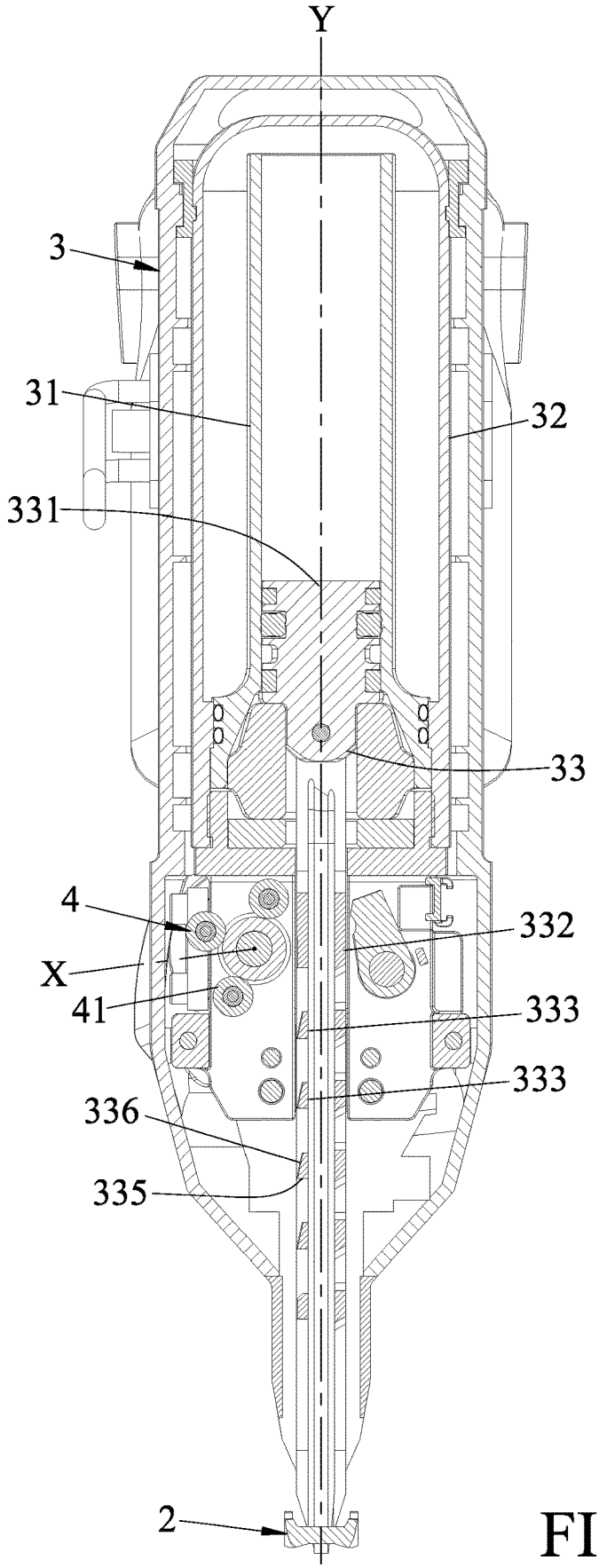
FIG. 7 is a view similar to FIG. 4, illustrating a lifting wheel being disengaged from a nail-striking member.
Figure 8:
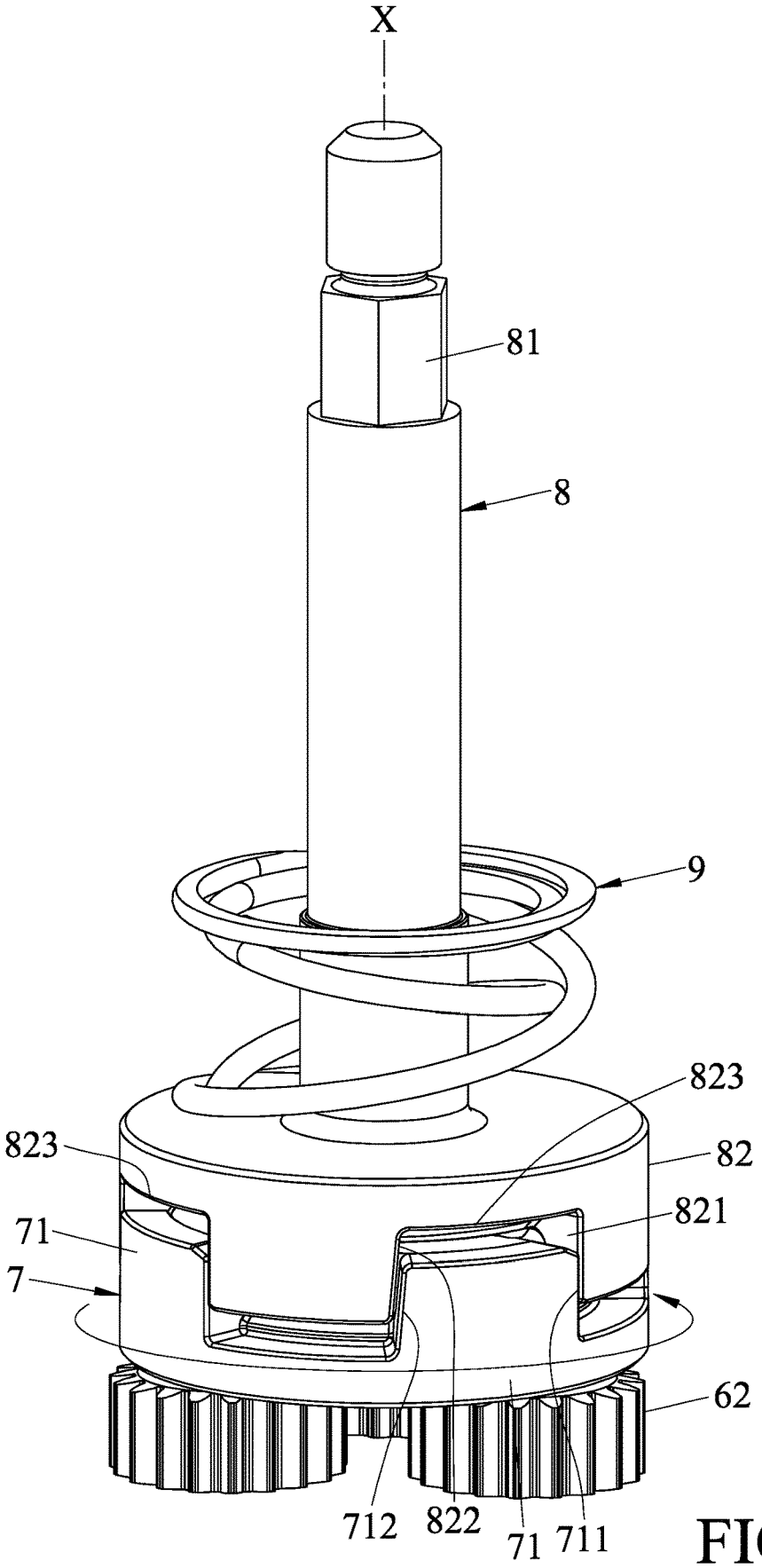
FIG. 8 is a view similar to FIG. 5, illustrating the transmission shaft at a position between the first position and a second position.

Referring to FIGS. 3, 5 and 6, the casing 5 is connected to the nail gun seat 21 of the muzzle unit 2, and surrounds the rotational axis (X). The motor unit 6 includes a motor 61 that is mounted in the casing 5, and a reduction gear set 62 that is mounted in the casing 5 and that is connected to and rotatable by the motor 61.

The driving member 7 is mounted in the casing 5, is connected to and drivable by the reduction gear set 62 of the motor unit 6 to rotate about the rotational axis (X), and has a plurality of spaced-apart first coupling portions 71 that are arranged about the rotational axis (X).

Each of the first coupling portions 71 of the driving member 7 has a first sliding surface 711 that is slightly inclined relative to the rotational axis (X), and a first contact surface 712 that faces the first sliding surface 711.

Figure 9:
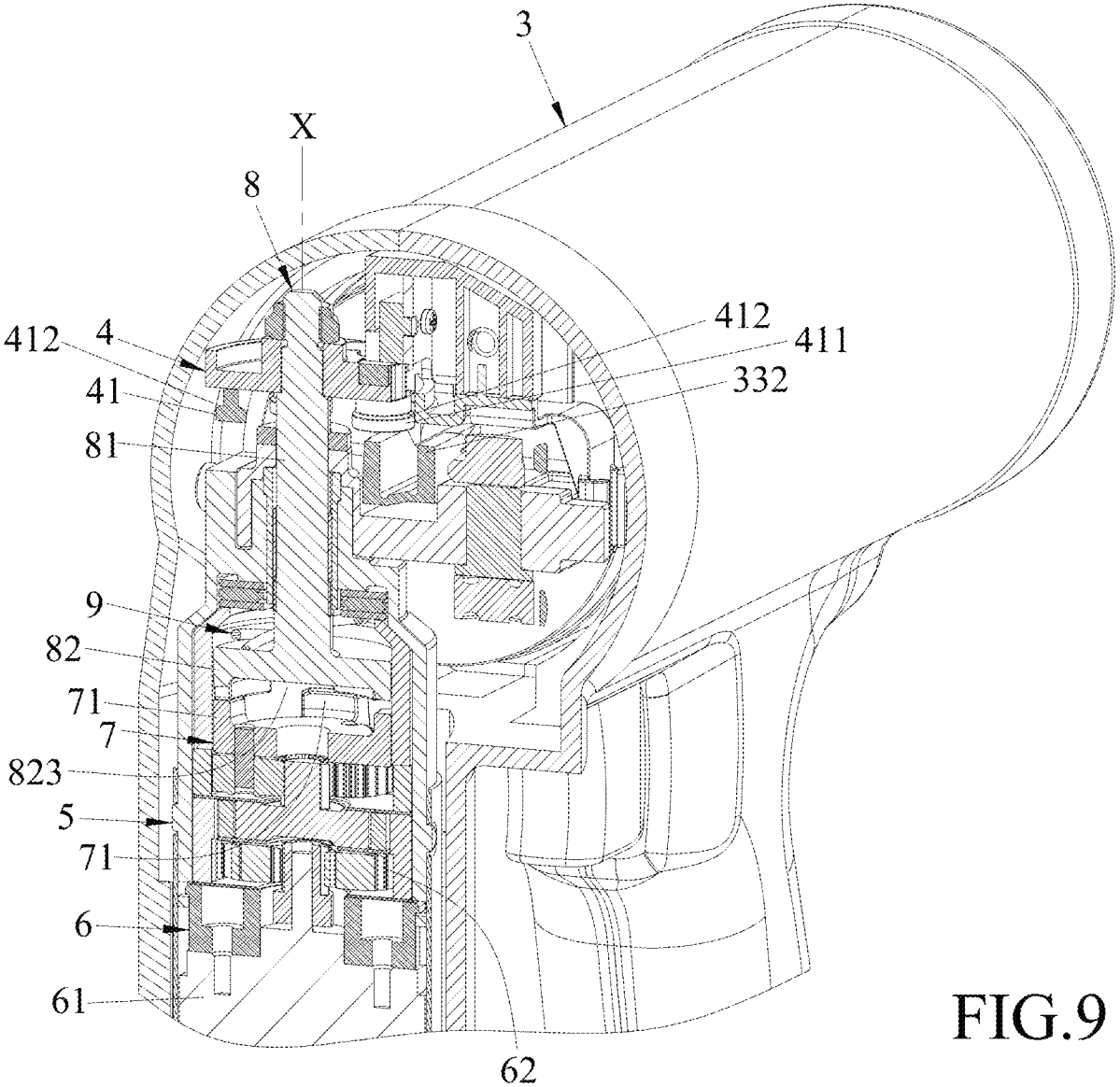
FIG. 9 is a view similar to FIG. 6, illustrating the transmission shaft at the second position.

The transmission shaft 8 is disposed between the driving member 7 and the lifting wheel 4, and is co-rotatably and co-movably connected to the lifting wheel 4 such that the transmission shaft 8 is convertible relative to the driving member 7 along the rotational axis (X) between a first position (see FIGS. 5 and 6) and a second position (see FIG. 9).

Specifically, the transmission shaft 8 has a shaft segment 81 and a coupling segment 82. The shaft segment 81 is connected to the lifting wheel 4. The coupling segment 82 is connected to the shaft segment 81, and is formed with a plurality of spaced-apart second coupling portions 823 that are arranged about the rotational axis (X) and that are respectively and movably engaged with the first coupling portions 71.

Each of the second coupling portions 823 of the transmission shaft 8 has a second sliding surface 821 that is slightly inclined relative to the rotational axis (X), and that faces the first sliding surface 711 of a corresponding one of the first coupling portions 71, and a second contact surface 822 that faces the second sliding surface 821.

When the transmission shaft 8 is at the first position, the lifting wheel 4 is at the default position and the first contact surface 712 of each of the first coupling portions 71 and the second contact surface 822 of a respective one of the second coupling portions 823 are in contact with each other. During rotation of the driving member 7, the first sliding surface 711 of each of the first coupling portions 71 abuts against the second sliding surface 821 of the respective one of the second coupling portions 823 (i.e., the first coupling portions 71 are engaged with the second coupling portions 823), thereby driving the transmission shaft 8 to rotate therewith, which further results in movement of the nail-striking subunit 33 along the striking axis (Y).

When the transmission shaft 8 is at the second position, the lifting wheel 4 is at the shifted position, the first contact surface 712 of each of the first coupling portions 71 and the second contact surface 822 of the respective one of the second coupling portions 823 are spaced apart from each other, and the first coupling portions 71 become disengaged from the second coupling portions 823 (see FIG. 9) such that the rotation of the driving member 7 does not result in movement of the nail-striking subunit 33 along the striking axis (Y).

The resilient member 9 is disposed between and abuts against the coupling segment 82 and the casing 5 for biasing the transmission shaft 8 to the first position.

During an operation of the present embodiment, the reduction gear set 62 is driven by the motor 61 to drive the driving member 7, the transmission shaft 8 and the lifting wheel 4 to co-rotate about the rotational axis (X). During such co-rotation, the contact surface 411 of one of the second engaging members 41 can, as mentioned above, come into contact with one of the lifting surface 335 and the sliding surface 336 of one of the first engaging members 333.

Referring to FIGS. 4, 5 and 6, if the contact surface 411 of the one of the second engaging members 41 abuts against the lifting surface 335 of one of the first engaging members 333, the lifting wheel 4 becomes engaged with the nail-striking subunit 33 and the nail-striking subunit 33 is driven to move along the striking axis (Y) in a direction opposite to the striking direction (D), pressurizing the air in the striking cylinder 31 and the storage cylinder 32.

When the lifting wheel 4 continues to rotate, the nail-striking subunit 33 becomes disengaged from the lifting wheel 4 as it reaches a predetermined position. Once disengaged from the lifting wheel 4, the nail-striking subunit 33 is urged by the air pressure in the striking cylinder 31 and the storage cylinder 32 to move in the striking direction (D) and strike the nail.

On the other hand, referring to FIGS. 3, 4, 8 and 9, if the contact surface 411 of the one of the second engaging members 41 is brought into contact with the sliding surface 336 of one of the first engaging members 333, the lifting wheel 4 is urged to shift from the default position to the shifted position, causing the transmission shaft 8 to simultaneously move from the first position to the second position. During such movement, the second sliding surface 823 of each of the second coupling portions 823 of the transmission shaft 8 slides along the first sliding surface 711 of the respective one of the first coupling portions 71 until the second coupling portions 823 are disengaged from the first coupling portions 71, and the resilient member 9 is compressed by the transmission shaft 8. At this time, the operation may be paused (e.g., by cutting off the power supply) so that any obstruction that causes the one of the second engaging members 41 to be brought into contact with the sliding surface 336 of the one of the first engaging members 333 may be manually removed.

When the operation resumes, the transmission shaft 8 is biased by the resilient member 9 to return to the first position and brings the lifting wheel 4 back to the default position, so that the lifting wheel 4 becomes engageable with the nail-striking subunit 33 again. As such, the one of the second engaging members 41 (or another one that comes next) may be engaged with a corresponding one the first engaging members 333, and the above-mentioned process as illustrated in FIGS. 4 to 6 may be repeated.

In summary, the embodiment of the electric nail gun according to the disclosure has the following advantages.

By virtue of the lifting wheel 4 and the transmission shaft 8 being movable along the rotational axis (X) and the contact surface 411 of each of the second engaging members 41 being slidable across the sliding surface 336 of a corresponding one of the first engaging members 333 of the nail-striking subunit 33, the rotation of the driving member 7 will not be interrupted during the operation. As a result, the motor 61 and the reduction gear set 62 are prevented from experiencing any reaction force resulting from undesirable obstruction and thus are prevented from being damaged.

In addition, unlike the prior art, which includes components such as the engaging members 17 and the stopping protrusions 152 of the ring gear 153 that experience wear and tear from the idling of the motor 14, the present embodiment does not include components of the like and therefore requires less maintenance. Furthermore, since the aforementioned components in the prior art are all separate parts, in the absence of similar components, the present embodiment should have a simpler assembly process.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electric nail gun comprising:

a muzzle unit that surrounds a striking axis and that includes a nail gun seat adapted for loading a nail;

a cylinder unit that includes a striking cylinder connected to said muzzle unit along the striking axis, and a nail-striking subunit disposed in said muzzle unit and said striking cylinder, extending along the striking axis, and adapted to be driven by air pressure in said striking cylinder to move along the striking axis for striking the nail;

a lifting wheel that is mounted to said muzzle unit, and that is rotatable about and movable along a rotational axis, said lifting wheel being movable along the rotational axis between a default position, where said lifting wheel is engageable with said nail-striking subunit such that rotation of said lifting wheel results in movement of said nail-striking subunit along the striking axis so as to increase the air pressure in said striking cylinder, and a shifted position, where said lifting wheel is not engageable with said nail-striking subunit;

a casing that is connected to said muzzle unit, and that surrounds the rotational axis;

a motor unit that is mounted to said casing;

a driving member that is mounted in said casing, that is connected to and drivable by said motor unit to rotate about the rotational axis, and that has a plurality of spaced-apart first coupling portions arranged about the rotational axis; and a transmission shaft that is disposed between said driving member and said lifting wheel, that has a plurality of spaced-apart second coupling portions arranged about the rotational axis and respectively and movably engaged with said first coupling portions, and that is co-rotatably and co-movably connected to said lifting wheel such that said transmission shaft is convertible relative to said driving member along the rotational axis between a first position, where said lifting wheel is at the default position such that rotation of said driving member results in movement of said nail-striking subunit along the striking axis, and a second position, where said lifting wheel is at the shifted position such that rotation of said driving member does not result in movement of said nail-striking subunit along the striking axis.

2. The electric nail gun as claimed in claim 1, wherein:

the striking axis extends in a striking direction that is perpendicular to the rotational axis;

said nail-striking subunit has a firing pin adapted for striking the nail, and a plurality of spaced-apart first engaging members fixed on said firing pin and arranged in the striking direction, each of said first engaging members having a lifting surface that faces the striking direction, and a sliding surface that is connected to said lifting surface, that is slanted with respect to a direction of the rotational axis, and that extends from said firing pin in a direction away from said nail gun seat and the rotational axis;

said lifting wheel includes a plurality of spaced-apart second engaging members arranged about the rotational axis, each of said second engaging members being provided to contact one of said lifting surface and said sliding surface of one of said first engaging members;

when said lifting wheel is engaged with said nail-striking subunit at the default position, at least one of said second engaging members abuts against said lifting surface of at least one of said first engaging members; and when one of said second engaging members is brought into contact with said sliding surface of one of said first engaging members, said one of said second engaging members is urged by said sliding surface to slide thereacross, thereby driving said lifting wheel to move from the default position to the shifted position.

3. The electric nail gun as claimed in claim 2, wherein:

each of said second engaging members has a contact surface for abutting against said lifting surface, and a stopping shoulder surface connected to said contact surface; and each of said first engaging members further has a restricting shoulder surface connected to said lifting surface and facing said firing pin of said nail-striking subunit such that, when said contact surface of a corresponding one of said second engaging members abuts against said lifting surface of a corresponding one of said first engaging members, said restricting shoulder surface faces said stopping shoulder surface of the corresponding one of said second engaging members, thereby preventing said lifting wheel from moving from the default position to the shifted position.

4. The electric nail gun as claimed in claim 2, wherein:

each of said first coupling portions of said driving member has a first sliding surface that is slightly inclined relative to the rotational axis; and each of said second coupling portions of said transmission shaft has a second sliding surface that is slightly inclined relative to the rotational axis, and that faces said first sliding surface of a corresponding one of said first coupling portions such that, during rotation of said driving member, said first sliding surface abuts against said second sliding surface, thereby driving said transmission shaft to rotate therewith, and during movement of said transmission shaft from the first position to the second position, said second sliding surface slides along said first sliding surface.

5. The electric nail gun as claimed in claim 4, wherein:

each of said first coupling portions of said driving member further has a first contact surface that faces said first sliding surface;

each of said second coupling portions of said transmission shaft further has a second contact surface that faces said second sliding surface;

when said transmission shaft is at the first position, said first contact surface and said second contact surface are in contact with each other; and when said transmission shaft is at the second position, said first contact surface and said second contact surface are spaced apart from each other.

6. The electric nail gun as claimed in claim 2, wherein said transmission shaft has a shaft segment that is connected to said lifting wheel, and a coupling segment that is connected to said shaft segment, and that is formed with said second coupling portions.

7. The electric nail gun as claimed in claim 6, further comprising a resilient member disposed between and abutting against said coupling segment and said casing for biasing said transmission shaft to the first position.

* * * * *